United States Patent [19]

Austin et al.

[11] 4,279,933

[45] Jul. 21, 1981

[54] EXPANDABLE FOOD PACKAGE CONTAINER

[75] Inventors: John J. Austin, La Grange, Ill.; George Webinger, Minneapolis, Minn.

[73] Assignee: Champion International Corporation, Stamford, Conn.

[21] Appl. No.: 116,911

[22] Filed: Jan. 30, 1980

[51] Int. Cl.[3] ..... B65D 5/28; B65D 77/02; B65D 81/34

[52] U.S. Cl. ..... 426/124; 206/620; 206/631; 229/33; 229/8; 229/DIG. 3; 229/41 C; 426/111; 426/113; 426/234; 220/403; 220/462

[58] Field of Search ..... 426/111, 124, 107, 234, 426/113; 229/33, 31 R, 41 C, 41 D, 8, 36, DIG. 3; 220/403, 462; 206/620, 631

[56] References Cited

U.S. PATENT DOCUMENTS

| | | | |
|---|---|---|---|
| 727,723 | 5/1903 | Webb | 229/33 |
| 2,243,080 | 5/1941 | Brogden | 229/33 |
| 2,792,167 | 5/1957 | Sparks | 229/8 |
| 2,819,976 | 1/1958 | Hines | 426/111 |
| 3,040,957 | 6/1962 | Meyers | 229/33 |
| 3,184,147 | 5/1965 | Wolowicz | 229/33 |
| 3,507,668 | 4/1970 | Bridgford | 229/33 |
| 3,733,023 | 5/1973 | Arneson | 229/31 R |
| 3,734,749 | 5/1973 | Bridgford | 426/111 |
| 3,851,574 | 12/1974 | Katz et al. | 426/107 |
| 3,873,738 | 3/1975 | Zoeller et al. | 426/111 |
| 3,985,285 | 10/1976 | Kitagawa | 229/8 |
| 4,036,423 | 7/1977 | Gordon | 426/111 |

FOREIGN PATENT DOCUMENTS

| | | | |
|---|---|---|---|
| 1110600 | 10/1954 | France | 229/33 |
| 2223250 | 11/1974 | France | 229/31 R |

*Primary Examiner*—Steven L. Weinstein
*Attorney, Agent, or Firm*—Evelyn M. Sommer

[57] ABSTRACT

A paperboard container for use in a microwave oven to cook an expandable food has an octagonal bottom support panel, upwardly and outwardly extending trapezoidal side panels connected to each edge of the bottom support panel, and a pop-up cover of overlapped, semi-ovoid top panels. A top panel is foldably connected to an edge of each of the side panels and a circular seal is removably attached to one of the top panels and an opposed one thereof to close the container. Upon removal of the seal, the top panels assume a substantially upright position as extensions of the side panels to enclose and support, along with the bottom support panel and side panels, an expanded food package.

8 Claims, 9 Drawing Figures

Fig. 1.
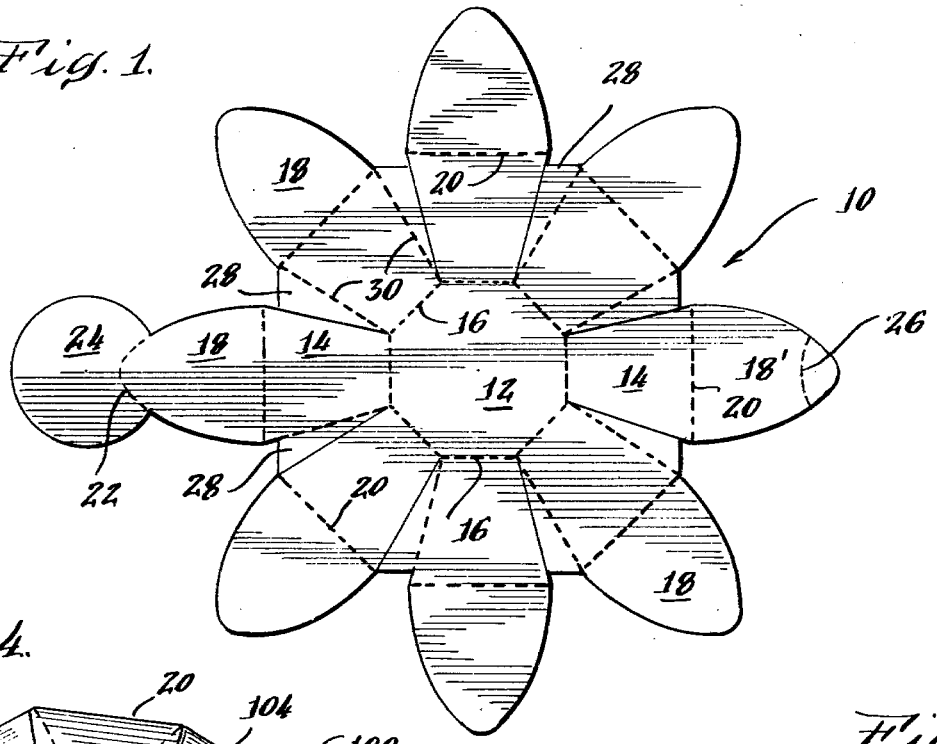
Fig. 4.
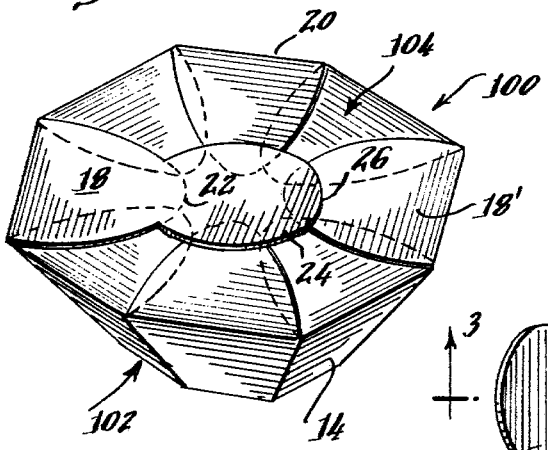
Fig. 2.
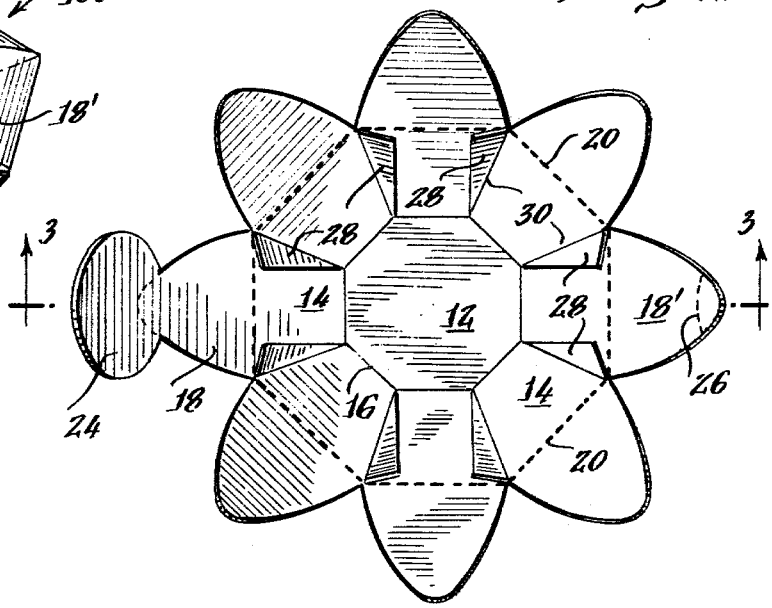
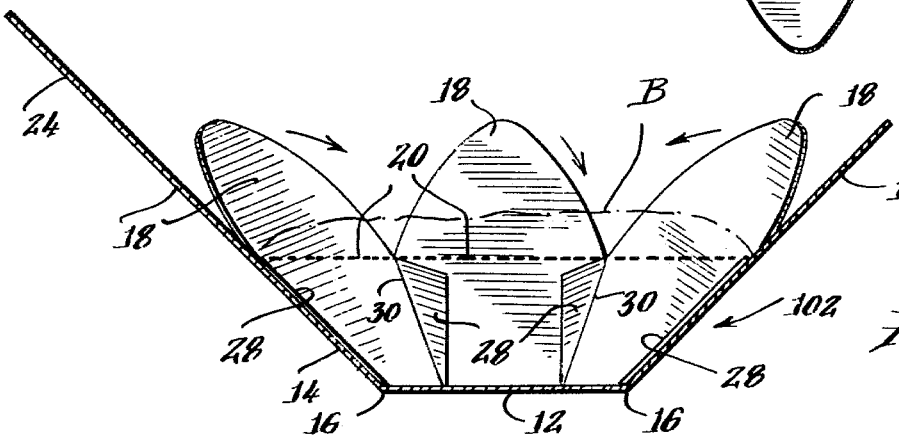
Fig. 3.

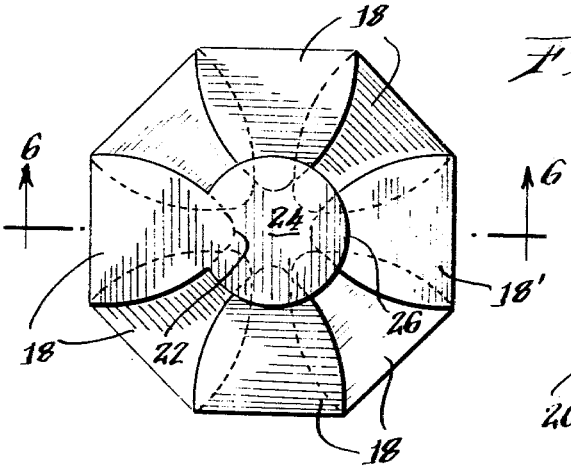
Fig. 5.
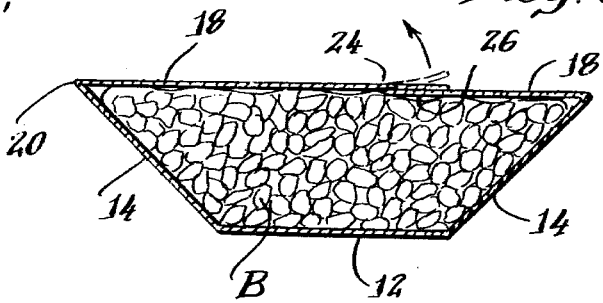
Fig. 6.
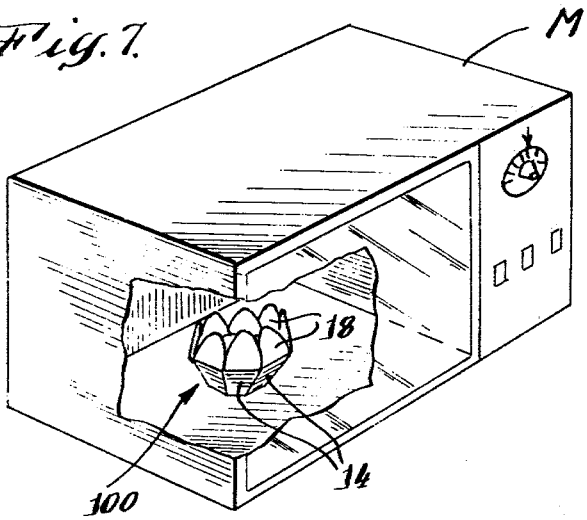
Fig. 7.
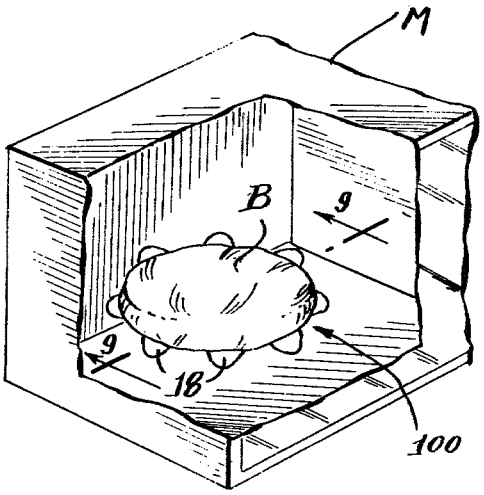
Fig. 8
Fig. 9.
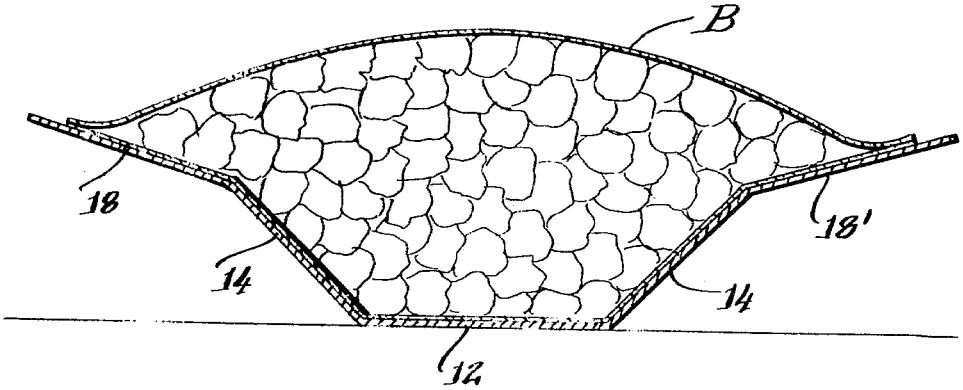

EXPANDABLE FOOD PACKAGE CONTAINER

BACKGROUND OF THE INVENTION

1. Field Of The Invention

This invention relates to a novel container, and more particularly, to a container for housing an expandable food package in a stored, non-expanded condition and in an expanded condition having substantially increased volume, the container being constructed of non-metallic materials for use in a microwave oven.

2. Description Of The Prior Art

Expandable food packages have been constructed for use, for example, in packaging and cooking corn kernels to form popcorn. Generally, the package is placed over a heat source under the influence of which cooking fats or oils, placed in the package, melt and form a gas while simultaneously the corn kernels are cooked to form the popcorn. The combination of expanding gas and puffing of the corn kernels cause the package to expand.

Prior art packages and containers for cooking such an expandable food generally utilize a shallow metal container for holding the food to be cooked covered by a thin aluminum foil cover. The cover expands under the influence of internal pressure from the cooked food to provide an internal volume greater than the original size, enabling the cooked food to be retained within the metallic container. An example of such a container or package is illustrated in U.S. Pat. No. 3,244,356 to Wolowicz, issued Apr. 5, 1966.

A principal advantage of using an expandable package in a container in which cooking can be performed, is the resulting economy of space in the storing and stacking of the packaged containers. Another advantage is the convenience for the user of not having to transfer or handle the cooking ingredients stored in the package. Unfortunately, packages incorporating metals, such as aluminum foil, cannot be used in a microwave oven because the metal acts as a shield, thereby preventing the energy from reaching the food to cook it. Therefore, in such packages, the food cannot be heated and cooked. As a result, it has become necessary to design a container for an expandable food package which is entirely non-metallic, so it can be used in a microwave oven heating environment.

One such package is illustrated in U.S. Pat. No. 4,036,423, issued to Gordon on July 19, 1977. In this patent, a non-metallic container for an expandable food package is formed from sheet material such as paperboard, polyethylene, paperboard lamination or combinations thereof sufficiently resistant to leakage of cooking oils and fats. The container includes a base portion and a cover. The base portion includes an open container section having a polygonally-shaped bottom panel having side panels connected thereto which taper upwardly and outwardly to receive food, such as uncooked kernels of corn with congealed cooking oil. An expandable cover is integrally attached to a flange portion connected to the side panels of the container along its entire outer periphery to enclose the base portion and food within the container. The flange and integral cover are then folded on top of the base and side panels to complete the construction. In use, the flanges are unfolded and the cover allowed to expand upon heating of the corn kernels and congealed cooking oil in a microwave oven; the cover expanding as the kernels expand. After cooking, the cover can be removed to expose the kernels for eating.

A principal disadvantage of the container illustrated in U.S. Pat. No. 4,036,423 is that the expandable cover is formed integrally with the container. This requires an additional manufacturing step during the formation of the container and requires the modification of standard carton closing machines in the manufacture of the finished container, both of which are highly undesirable, as they increase the cost of manufacture of the container.

In accordance with the present invention, the expandable food package is completely separate from the container and is loaded into the container prior to closing the same.

The container of the present invention also features a quick opening seal wherein the sides of the container will automatically pop open and extend upwardly and outwardly to form a bowl for confining the expanded food product upon heating in a microwave oven.

Finally, the container is formed from paperboard or chemically treated, grease-resistant paperboard lamination whereby it is especially suited for use in a microwave oven.

SUMMARY OF THE INVENTION

The container of the present invention includes a bottom support panel of a regular polygonal shape, preferably an octagon. Upwardly and outwardly extending side panels are connected to each edge of the polygonally shaped bottom support panel. Each one of the side panels is connected to adjacent ones thereof by overlapping flanges to form with the bottom support panel a bowl adapted to receive an expandable food bag or package in stored condition. An integral pop-up cover is adapted to enclose and store the expandable food bag or package in the bowl when closed, and to provide additional side support for the bag when opened and the bag is expanded.

The cover includes a plurality of overlapped, separate top panels of generally semi-ovoid shape. Each panel has an edge foldably connected to one of the side panels. One of the semi-ovoid top panels is connected by a perforated score line to a central seal or tab. The central seal or tab is circular in shape.

To close the cover over the stored expandable bag or package, the semi-ovoid top panels are folded about their fold lines to the side panels causing adjacent edges thereof to overlap. The central tab is adhesively secured to the top portion of an opposed semi-ovoid top panel up to a perforated score line provided therein. This maintains the integrity of the package until it is ready to be used.

When the package is ready to be used, it is placed in a microwave oven. The top seal or tab is pulled upwardly and removed from the package. The perforated score lines enable ready breaking away of the central seal from the package. Removal of the central seal to open the container will cause each of the semi-ovoid top panels to resiliently spring upward to a substantially upright position.

The effect of the microwave energy on the package is to build up internal pressure within the expandable bag causing expansion of the same within the bowl-shaped container. The semi-ovoid top panels form an extension of the side panels connected to the base portion to further contain the expanded food product after it has been cooked.

BRIEF DESCRIPTION OF THE DRAWINGS

Further objects and advantages of the invention will appear from the following description and claims, and from the accompanying drawings, wherein:

FIG. 1 is a plan view of a blank for forming the container of the present invention;

FIG. 2 is a top plan view of the blank of FIG. 1 partially folded to form the container of the present invention;

FIG. 3 is a cross-sectional view of the partially folded blank of FIG. 2 taken substantially along the plane indicated by line 3—3 of FIG. 2;

FIG. 4 is a perspective view of the folded container of the present invention;

FIG. 5 is a top plan view of the container of FIG. 4;

FIG. 6 is a cross-sectional view of the container of FIG. 5 taken substantially along the plane indicated by line 6—6 of FIG. 5;

FIG. 7 is a perspective view of an opened container of the present invention placed in a microwave oven used to expand the contents of the container;

FIG. 8 is a view similar to FIG. 7, but with the contents of the container fully expanded; and FIG. 9 is a cross-sectional view of the container of the present invention taken substantially along the plane indicated by line 9—9 of FIG. 8.

DESCRIPTION OF THE PREFERRED EMBODIMENT

Referring now to the drawings in detail, wherein like numerals indicate like elements throughout the several views, the container 100 of the present invention is illustrated in FIG. 4.

Container 100 has a base portion 102 including a bottom support panel 12 of a regular polygonal shape, preferably an octagon. Base portion 102 further includes an upwardly and outwardly extending side wall panel 14 foldably connected to each free edge 16 of the polygonally shaped bottom support panel 12. Each one of said side panels 14 is connected to an adjacent one thereof to form with said bottom support panel 12 a bowl-shaped base portion which is adapted to receive an expandable food bag B in stored condition, as shown in FIGS. 3 and 6.

Container 100 also includes a pop-up cover 104. Cover 104 is adapted to enclose and store expandable food bag B in the bowl shaped base portion 102 of container 100 when closed and provide additional side support for the bag B when the bag is expanded in a microwave oven.

Cover 104 comprises a plurality of overlapped, separate top panels 18 of generally semi-ovoid shape. A panel 18 has its lower edge 20 resiliently and foldably connected to the top of one of the side panels 14.

One of the top panels 18 is connected by a perforated score line 22 to a generally circular, central seal or tab 24. In forming the cover to enclose the expandable bag B, the semi-ovoid top panels are folded about their edges 20 and have their side edges overlapped, as shown in FIGS. 3 to 5. Central seal or tab 24 is then adhesively tacked to the top of an opposed semi-ovoid top panel 18' along a generally circular, perforated, score line arc 26 in the top panel 18', while overlapping each of the other remaining top panels 18.

In use, the central seal or tab 24 is simply removed as shown in FIG. 6 by inserting the finger beneath the tab and pulling it upwardly causing the perforated score lines 22 and 26 adhering the tab to opposed semi-ovoid top panels 18 and 18' to tear. Upward removal and rupture of the central seal will cause the semi-ovoid top panels 18 to pop to a substantially upright position as shown in FIG. 7. In this condition, the expandable food bag B can be heated in a microwave oven M to cause the bag and food within the bag to expand. Expansion of the bag is confined by the upwardly extending semi-ovoid, now opened, top panels 18, which will aid in containing the cooked food product within the container ready to be eaten, as shown in FIGS. 8 and 9.

The container 100 is formed from paperboard or a grease-resistant, specially chemically treated leak-proof paperboard lamination. The container 100 is formed from the blank 10 illustrated in FIG. 1.

Blank 10 includes the regular polygonally shaped bottom support panel 12, and as illustrated, the preferred shape is octagonal. Secured to each edge 16 of octagonal bottom support panel 12 are generally trapezoidal shaped side panels 14. Every other side panel 14 includes a substantially V-shaped panel 28 connected by a score line 30 to opposed edges thereof. Panels 28 are overlapped with an adjacent side panel 14 and are adhesively bonded thereto as shown in FIG. 2 in order to provide the upward and outward taper to the side panels 14 extending from bottom support panel 12 thereby forming the bowl-shaped base of 102 of the container 100.

Semi-ovoid top panels 18 are then foldably connected along their base edge 20 to the top edge of each of the side panels 14, as shown in FIG. 3. The central tab 24 is connected by the perforated score line 22 to one of the semi-ovoid top panels. A perforated score line 26 is provided in a circular arc along opposed semi-ovoid top panel 18' for adhesive securement to central circular seal 24 to complete the construction of the container 100, as illustrated in FIGS. 4 and 5, when the panels 18 are overlapped and the seal 24 tacked to panel 18' while overlapping the remaining top panels 18.

What is claimed as new is:

1. A quick-opening, non-metallic container housing an expandable food bag in a non-expanded stored condition and in an expanded condition having a substantially increased volume when heated, said container comprising:

a base portion including a bottom support panel of regular polygonal shape, an upwardly and outwardly extending trapezoidal side panel connected to each edge of said polygonally shaped bottom support panel, each one of said side panels being connected to the adjacent one thereof by a V-shaped panel to form with said bottom support panel a bowl receiving said expandable food bag in stored condition, and an integral pop-up cover securely enclosing and storing said expandable food bag in said bowl and providing additional side support for the bag when opened and the bag is expanded, said cover including a plurality of separate top panels, each top panel being generally semi-ovoid in configuration and having a straight edge and curved edge, said straight edge resiliently and foldably connected to one of said side panels, the edge between each top panel and said panel being greater in length than said edge between each side panel and bottom support panel said top panels being arranged such that adjacent side edges thereof overlap while the distal end of each top panel is spaced from the distal end of the opposed top panel defining an opening over the top center of the container, and a seal tab member of generally circular configuration, said seal tab member being removably connected to the distal end of one of said top panels, said seal tab member being releasably attached to the distal end of the top panel opposed to said one top panel while overlapping the distal end of each of the remaining top panels so that the opening over the top center of the container is closed by the seal tab member, said seal tab member securely holds all of said top panels in a closed position wherein the removal of said seal tab member will open said container thereby causing each of said top panels to assume a substantially upright position.

2. The container of claim 1 wherein said base portion and cover portion are formed from paperboard material.

3. The container of claim 2 wherein said bottom support panel is octagonal in shape and each of said side panels is trapezoidal in shape, one of the parallel edges of said trapezoidal side panel being connected to one of the edges of said octagonally-shaped bottom panel.

4. The container of claim 3 wherein every other side panel includes a V-shaped extension panel connected to opposite edges thereof which is overlapped and adhered to an adjacent side panel.

5. The container of claim 1 wherein said bottom support panel is octagonal in shape and each of said side panels is trapezoidal in shape, one of the parallel edges of said trapezoidal side panel being connected to one of the edges of said octagonally-shaped bottom panel.

6. The container of claim 1 wherein every other side panel includes a V-shaped extension panel connected to opposite edges thereof which is overlapped and adhered to an adjacent side panel.

7. The container of claim 1 wherein said seal tab member is releasably attached to the distal end of said opposed top panel along a perforated score line.

8. The container of claim 1 wherein said seal tab member is removably connected to the distal end of said one top panel along a circular arc defined by a perforated score line on said one top panel.

* * * * *